United States Patent [19]

Choi

[11] 4,278,363

[45] Jul. 14, 1981

[54] ROCK BOLT AND INSTALLATION SYSTEM

[75] Inventor: Dai S. Choi, Ponca City, Okla.

[73] Assignee: Conoco, Inc., Ponca City, Okla.

[21] Appl. No.: 50,586

[22] Filed: Jun. 21, 1979

[51] Int. Cl.[3] ..... E21D 20/02

[52] U.S. Cl. ..... 405/260; 405/259

[58] Field of Search ..... 405/236, 248, 259, 260; 175/67, 394, 422; 299/17

[56] References Cited

U.S. PATENT DOCUMENTS

| | | | |
|---|---|---|---|
| 2,129,978 | 9/1938 | Yokoyama | 405/248 |
| 3,074,240 | 1/1963 | Elliott | 405/236 |
| 3,494,133 | 2/1970 | Ahlgren et al. | 405/260 |
| 3,608,317 | 9/1971 | Landau | 405/248 X |
| 3,842,608 | 10/1974 | Turzillo | 405/236 |
| 3,899,893 | 8/1975 | Banerjee et al. | 405/259 |

FOREIGN PATENT DOCUMENTS

| | | | |
|---|---|---|---|
| 936082 | 7/1956 | Fed. Rep. of Germany | 405/260 |

*Primary Examiner*—David H. Corbin

*Attorney, Agent, or Firm*—Richard W. Collins

[57] ABSTRACT

A rock bolt installation system including a device for applying an insertion force to a rock bolt and a device for supplying high pressure jetting fluid through the rock bolt, and a method of operating the system to rapidly install rock bolts. The rock bolt itself includes a flow passage with a restricted nozzle outlet at one end and an exterior groove for removal of jetting fluid and formation cuttings.

7 Claims, 3 Drawing Figures

ROCK BOLT AND INSTALLATION SYSTEM

BACKGROUND OF THE INVENTION

This invention relates to a method and apparatus for rapidly installing rock bolts in a rock formation such as a mine roof, and to a unique rock bolt structure.

It is common practice in construction and mining operations to utilize rock bolts to support a rock formation around mine and tunnel roofs and walls. Many specific rock bolt designs and installation procedures and systems have been developed. Examples of typical prior art rock bolt designs are described in U.S. Pat. Nos. 3,311,012; 3,377,807 and 3,316,797.

A method of anchoring a rock formation including forming a hole and inserting a bolt larger than the hole is described in U.S. Pat. No. 3,899,893.

It is also known to form a hole through an earth formation by a jet of drilling fluid. A tool for this purpose is described in U.S. Pat. No. 3,536,151.

In spite of the numerous rock bolting systems presently available, there is a need for a rock bolt and rock bolting system which can rapidly and securely support a structure such as a mine roof formation. Modern continuous mining machines often are utilized at only a fraction of their capacity because present bolting techniques cannot keep up with the mining machine.

Accordingly, there is a need for a bolting system which enables installation of rock bolts rapidly enough to keep up with modern mining machinery, so that improved mining efficiency can be obtained.

It is an object of this invention to provide an improved rock bolt.

It is a further object to provide an improved method of installing rock bolts.

It is still another object to provide an improved rock bolt installation system.

SUMMARY OF THE INVENTION

According to the present invention, an improved rock bolt and a method and apparatus for installing such rock bolts are provided.

The rock bolt of this invention is an elongated, preferably steel, rod having an axial flow passage terminating in a jet nozzle. The bolt also has an exterior groove formed therein for removal of drilling fluid and formation cuttings.

The bolting system of this invention includes a mobile, articulated device for applying an insertion force to the rock bolts and a pressurized fluid source for supplying high pressure fluid to a jet nozzle in the end of the rock bolt to jet a hole in a rock formation in advance of the rock bolt.

The method of installing rock bolts includes forming a hole in a rock formation by a high pressure fluid jet while inserting a rock bolt having a diameter larger than the hole formed by the fluid jet.

DESCRIPTION OF THE PREFERRED EMBODIMENTS

Figure 2:
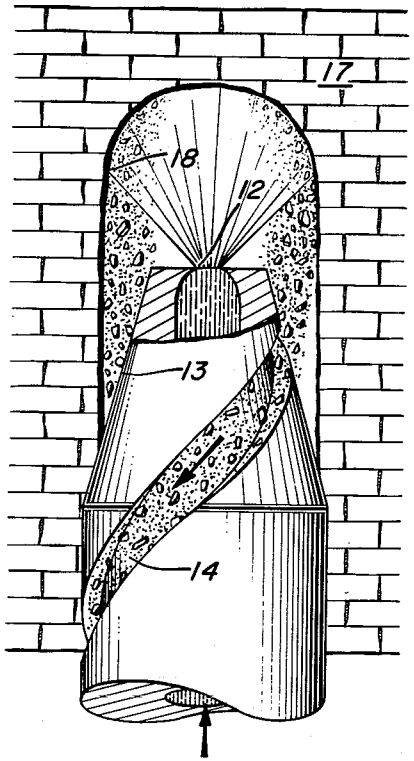
FIG. 2 is a view illustrating the jetting action of the bolt installation procedure of the invention.
Figure 1:
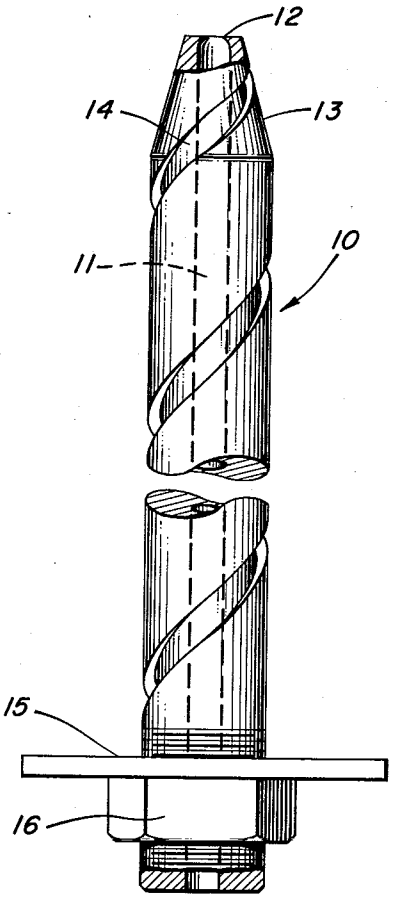
FIG. 1 is a side elevation showing the structure of a rock bolt according to the invention.

The preferred design of a rock bolt in accordance with the invention is shown in FIG. 1. Rock bolt 10 is an elongated, preferably steel, member having an axial bore 11 terminating in a restricted jet nozzle 12 at the tapered end 13 of rock bolt 10. An exterior helical groove 14 is formed about rock bolt 10 to provide a return path for drilling fluid and formation cuttings (FIG. 2). A conventional anchor plate 15 and tensioning nut 16 are installed after the bolt is in position. An angle washer (not shown) may be used between plate 15 and nut 16 if bolt 10 is positioned at an angle to the surface of the structure being supported.

Rock bolts 10 may be from 0.5 to 5 meters in length, and generally are from 1 to 2 meters. Their outer diameter is from 1 to 3 centimeters, and preferably about 2 centimeters. The nozzle 12 has an opening less than one third the bolt diameter, and preferably about 0.15 to 0.30 times the bolt diameter. The exterior groove 14 extends the length of the bolt. A longitudinal groove or grooves could be used in place of a helical groove, but the supporting effect is enhanced with the helical groove as shown.

The jetting action of the method of the invention is illustrated in FIG. 2.

High pressure fluid (normally water) is pumped through nozzle 12 under high pressure, such as from 70 to 1400 kg/cm$^2$, preferably 350 to 700 kg/cm$^2$. The jet of fluid from nozzle 12 impinges against a formation and forms a bore 18 having a diameter less than the diameter of bolt 10. Bore 18 typically has a diameter of about 3 times the nozzle opening diameter, and about 70 to 90 percent of the bolt diameter. Jetting fluid and formation cuttings pass down groove 14 into the working area. As the bore 18 is formed, an insertion force is applied to bolt 10 forcing it into bore 18 in a tight fitting relationship to formation 17. The taper 13 at the end of the bolt assists in this operation.

The rate of insertion of bolt 10 must be coordinated with the jetting action so that the bore is not formed too large to provide a good gripping action on the bolt. The rate of insertion will depend on the fluid pressure used and the particular formation being jetted. For typical shale and sandstone formations as found above many United States coal seams, an insertion rate of 2 to 3 centimeters per second is possible using a fluid pressure of from 350 to 700 kg/cm$^2$.

When bolt 10 is completely inserted, the fluid injection is stopped and the fluid source disconnected. Anchor plate 15 and tensioning nut 16 are then installed. In some cases, a grouting may be injected through axial bore 11, preferably until said groove is substantially filled with grouting, to provide additional support.

Figure 3:
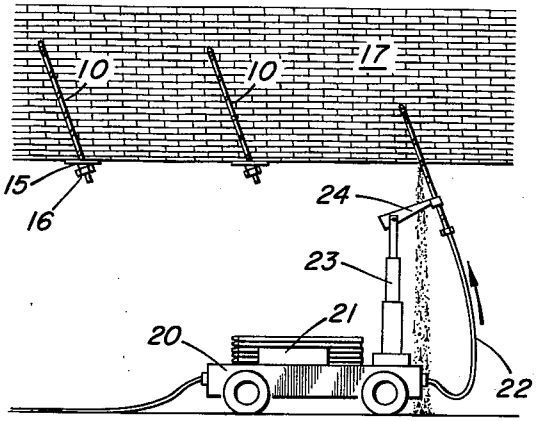
FIG. 3 is a side elevation illustrating the rock bolt installation system of the invention.

The installation system of the invention is illustrated in FIG. 3. A mobile vehicle 20 supports a high pressure pump 21 which supplies jetting fluid to bolt 10 via conduit 22. A telescoping cylinder 23 is also supported by vehicle 20, and through articulated linkage 24 forces bolt 10 into roof formation 17 as a bore is formed therein.

Mobile vehicles carrying articulated supports for drilling mine roof bolt holes are known. However, those devices require first drilling the hole and then installing and securing a bolt in the hole. The present invention provides an installation process wherein the bore formation and bolt installation are simultaneously accomplished. The system and procedure described herein enables a mine roof bolting crew to keep up with a continuous mining machine, providing much higher utilization of the mining machine and more efficient mining.

It will be appreciated that numerous variations of and modifications to the foregoing description of the preferred embodiments could be made without departing from the invention, which is to be defined by the appended claims.

I claim:

1. A method of installing a rock bolt in a mine roof comprising:

(a) providing a rock bolt having an axial fluid passage therethrough, a nozzle at one end of said passage having a diameter less than one third the diameter of the bolt, and a groove in the outer surface of the bolt providing a return fluid passage;

(b) pumping fluid through said nozzle under a pressure of 70 to 1400 kg/cm$^2$, said fluid impinging on said mine roof and forming a bore therein having a diameter less than the diameter of said bolt;

(c) applying force to said bolt to cause it to move into said bore as the bore is formed;

(d) discontinuing the pumping of said fluid; and (e) disconnecting the source of said fluid from said bolt whereby said bolt is retained in said bore to provide support to said mine roof.

2. The method of claim 1 wherein said fluid is pumped through said nozzle under a pressure of 350 to 700 kg/cm$^2$.

3. The method of claim 1 wherein said fluid is water and said bolt is forced into said bore at a rate of from 2 to 3 centimeters per second for at least a part of the operation.

4. The method of claim 1 wherein, after step (e), grouting is pumped into said axial passage until said groove is substantially filled with grouting.

5. The method of claim 1 wherein the diameter of said bore is from 70 to 90 percent of the diameter of said rock bolt.

6. A rock bolting system comprising:

(a) an elongated hollow rod having a tapered tip, an exterior groove along its length, and a nozzle at the end having said tapered tip, said nozzle having a diameter of from 15 to 30 percent of the diameter of said rod;

(b) fluid supply means connected to the end of said rod opposite said tapered tip, said fluid supply means being capable of supplying pressurized fluid under a pressure of 70 to 1400 kg/cm$^2$ through said rod to said nozzle;

(c) means for applying a force to said rod as said pressurized fluid is supplied to said nozzle whereby said rod can be inserted into a borehole formed in a mine roof by said pressurized fluid; and (d) mobile means supporting both said fluid supply means and said means for applying a force.

7. A rock bolting system in accordance with claim 6 including an articulated linkage connecting said rod and said means for applying a force.

* * * * *